US009067215B2

(12) United States Patent
Moe

(10) Patent No.: US 9,067,215 B2
(45) Date of Patent: Jun. 30, 2015

(54) APPARATUS FOR RECOVERING GOLD AND TRANSPORTING GRAVEL

(71) Applicant: Charles Moe, Albany, OR (US)

(72) Inventor: Charles Moe, Albany, OR (US)

( * ) Notice: Subject to any disclaimer, the term of this patent is extended or adjusted under 35 U.S.C. 154(b) by 0 days.

(21) Appl. No.: 14/067,070

(22) Filed: Oct. 30, 2013

(65) Prior Publication Data

US 2014/0116927 A1 May 1, 2014

Related U.S. Application Data

(60) Provisional application No. 61/720,797, filed on Oct. 31, 2012.

(51) Int. Cl.
*B03B 7/00* (2006.01)
*B03B 5/68* (2006.01)

(52) U.S. Cl.
CPC ..... *B03B 5/68* (2013.01)

(58) Field of Classification Search
CPC ..... B07B 1/00; B07B 11/06
USPC ..... 209/12.1, 13, 17, 18, 44, 235, 268
See application file for complete search history.

(56) References Cited

U.S. PATENT DOCUMENTS

| | | | | |
|---|---|---|---|---|
| 2,256,504 | A * | 9/1941 | Stewart | 209/437 |
| 2,437,671 | A * | 3/1948 | Carter | 209/160 |
| 4,839,034 | A * | 6/1989 | Dahlberg | 209/44 |
| 5,275,294 | A * | 1/1994 | Krenzler | 209/434 |
| 5,423,430 | A * | 6/1995 | Zaffiro et al. | 209/315 |
| 5,788,293 | A * | 8/1998 | Krenzler | 209/434 |
| 6,799,681 | B1 * | 10/2004 | Warren | 209/44 |
| 8,678,192 | B1 * | 3/2014 | Pung et al. | 209/44 |

* cited by examiner

*Primary Examiner* — Terrell Matthews

(57) ABSTRACT

An apparatus is configured to classify gravel and recover gold. The apparatus includes a bucket attached to a higher pressure water feed and a lower pressure water line. A make-up water supply is connected to the higher pressure water feed. A classifier assembly is attached to the bucket and configured to filter larger material from smaller material. The smaller material includes gold particles and gravel. A gold concentrator plate is connected to the bucket and configured to segregate the gold particles from the gravel. Water enters the higher pressure water feed and travels through the make-up water supply running across the gold concentrator plate and causing gold particles to be caught in the gold concentrator plate. Water additionally travels through the lower pressure water line with the gravel transporting the gravel away from the bucket.

3 Claims, 4 Drawing Sheets

APPARATUS FOR RECOVERING GOLD AND TRANSPORTING GRAVEL

RELATED APPLICATION

This application claims priority to provisional patent application U.S. Ser. No. 61/720,797 filed on Oct. 31, 2012, the entire contents of which is herein incorporated by reference.

BACKGROUND

The embodiments herein relate generally to devices used for obtaining gold from a gravel slurry.

Prior to embodiments of the disclosed invention, gold prospecting was done in the United States by running a gravel slurry through a sluice box. However, sluice boxes were stationary devices and the gravel being washed was rarely near the sluice box. This required mechanical transportation by shovel or bucket, many times up to thirty feet or more from the point of the gravel extraction to the sluice box.

In some countries, this gravel transportation was accomplished by a gravel pump. However, gravel pumps were poorly designed with many mechanical components that resulted in extreme wear by gravel and abrasive sand, requiring frequent rebuilding of the gravel pump. Embodiments of the disclosed invention solve these problems.

SUMMARY

An apparatus is configured to classify gravel and recover gold. The apparatus includes a bucket attached to a higher pressure water feed and a lower pressure water line. A make-up water supply is connected to the higher pressure water feed. A classifier assembly is attached to the bucket and configured to filter larger material from smaller material. The smaller material includes gold particles and gravel. A gold concentrator plate is connected to the bucket and configured to segregate the gold particles from the gravel. Water enters the higher pressure water feed and travels through the make-up water supply running across the gold concentrator plate and causing gold particles to be caught in the gold concentrator plate. Water additionally travels through the lower pressure water line with the gravel transporting the gravel away from the bucket.

In some embodiments, he classifier assembly further comprises a classifier carriage mechanically coupled to a classifier ring and a classifier grate. The gold concentrator plate further comprises an upper miner's moss covered with an expandable metal; and the upper miner's moss is further mechanically coupled to a plate. The bucket is attached to a lower miner's moss to further segregate gold particles. The bucket is attached to a nozzle and the nozzle is attached to the higher pressure water feed to direct water through the lower pressure water line.

BRIEF DESCRIPTION OF THE FIGURES

The detailed description of some embodiments of the invention is made below with reference to the accompanying figures, wherein like numerals represent corresponding parts of the figures.

DETAILED DESCRIPTION OF CERTAIN EMBODIMENTS

Figure 1:
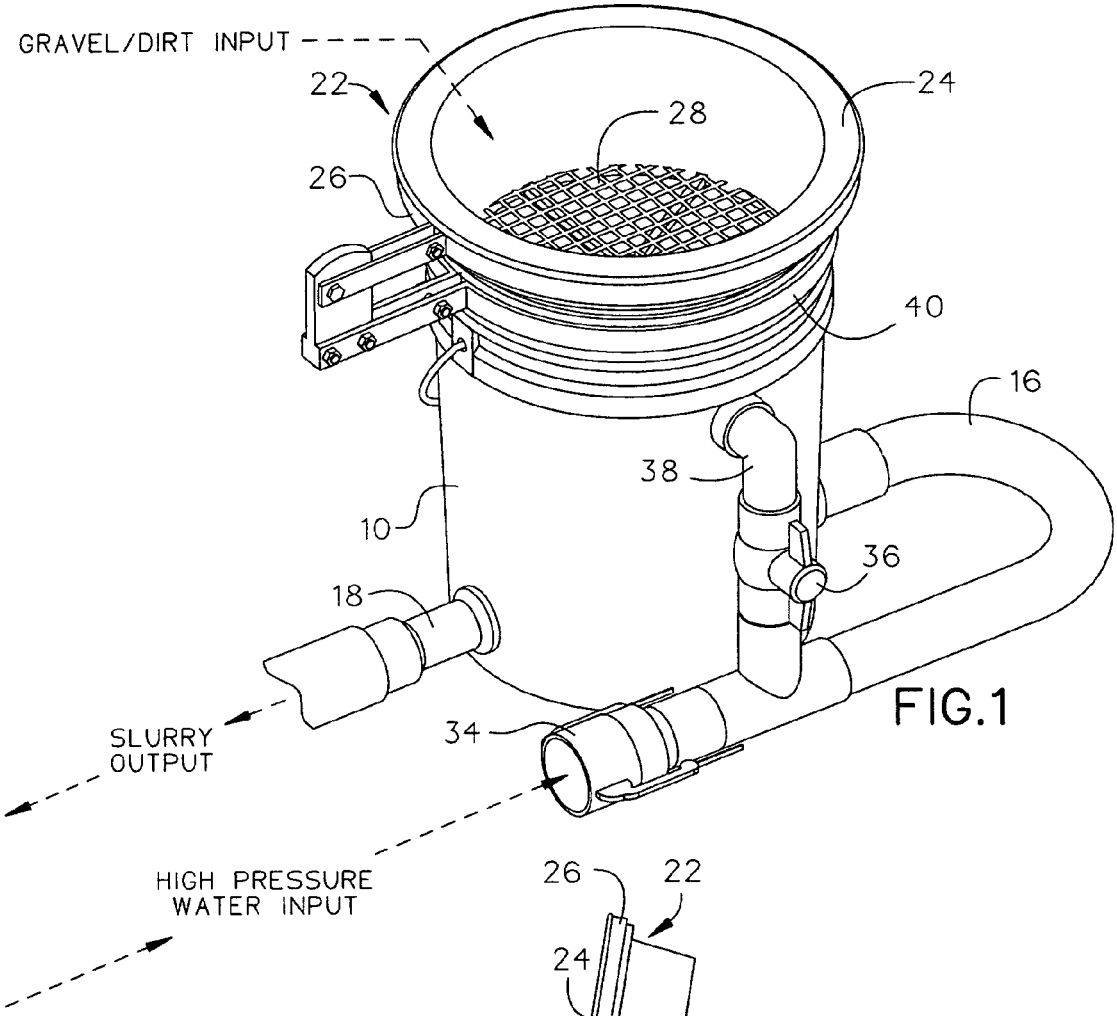
FIG. 1 is a perspective view of an embodiment of the invention.

By way of example, and referring to FIG. 1, one embodiment of the apparatus comprises bucket 10 mechanically coupled to classifier assembly 22. Bucket 10 is further mechanically coupled to a water transport system. In some embodiments, bucket 10 is a five gallon bucket. Bucket 10 is mechanically coupled to bucket ring and bracket 40 which can operate as a hinge as noted below.

The classifier assembly 22 comprises classifier carriage 24 mechanically coupled classifier ring 26 and classifier grate 28. Here, classifier assembly 22 is shown mechanically coupled to bucket 10 with a hinge such as bucket ring and bracket 40, but that need not necessarily be the case.

Figure 2:
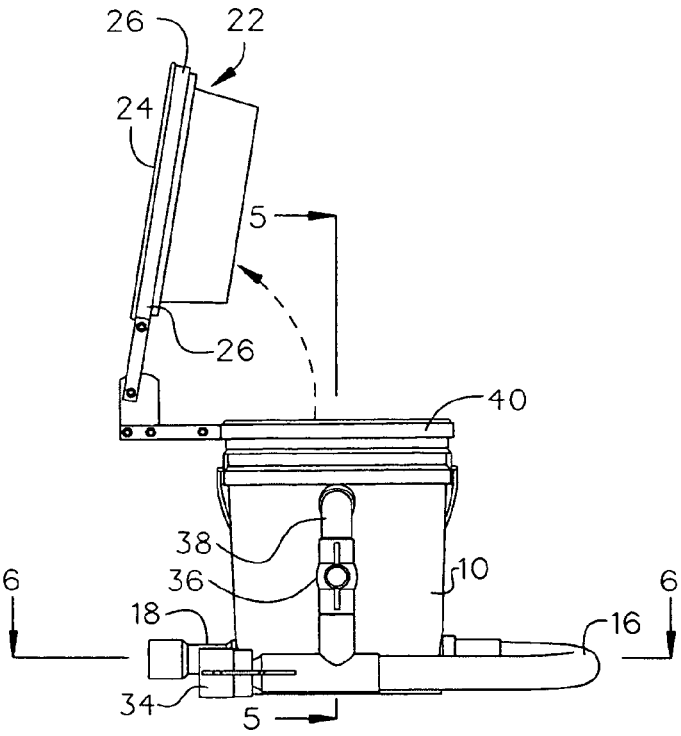
FIG. 2 is a side view of an embodiment of the invention demonstrated with the classifier top assembly shown in open configuration.
Figure 3:
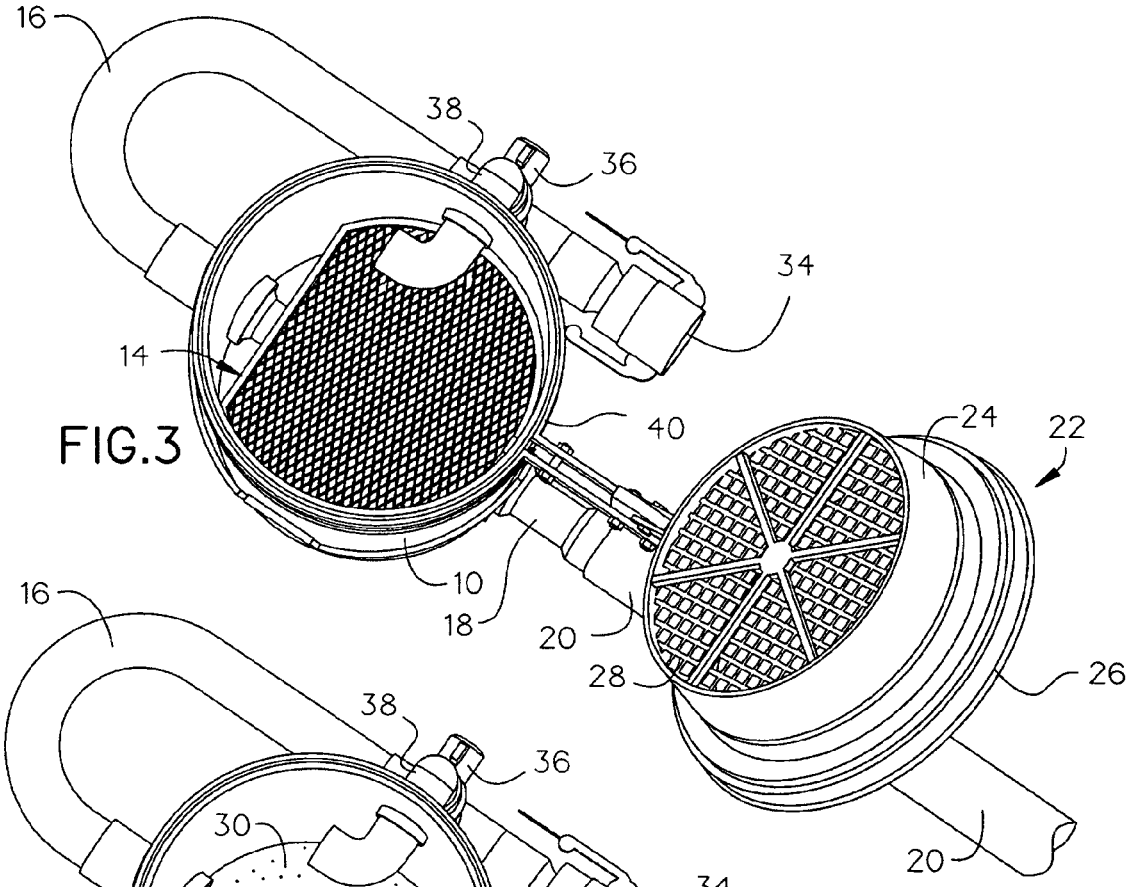
FIG. 3 is a top perspective view of an embodiment of the invention of the invention demonstrated with the classifier assembly shown in open configuration.
Figure 4:
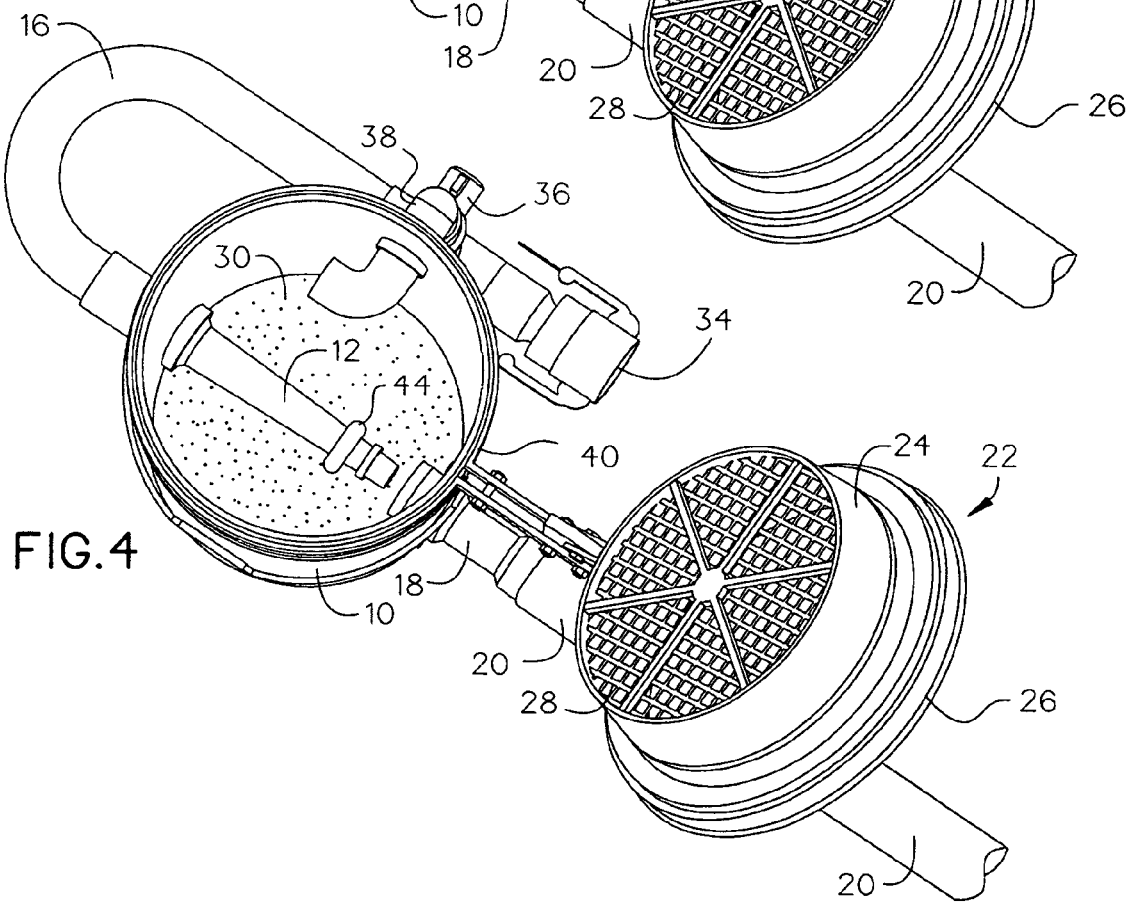
FIG. 4 is a top perspective view of an embodiment of the invention of the invention demonstrated with the classifier assembly shown in open configuration and omitting the gold concentrator plate.

FIG. 2, FIG. 3 and FIG. 4 show the water transport system in more detail. Nozzle 12 is covered by gold concentrator plate 14 and is mechanically coupled to higher pressure water feed 16. Nozzle 12 is spaced from and directed at flow restrictor 18. In some embodiments, nozzle 12 is held in place with eyebolt 44. Flow restrictor 18 is mechanically coupled to lower pressure water line 20 which is further attached to the sluice box which is not shown.

The bottom of bucket 10 is lined with miner's moss 30. Miner's moss 30 is a carpet of interwoven synthetic fibers that are used to trap and catch small material. In some embodiments, this can be substituted with other kinds of carpet. Miner's moss 30 is an important component of a gold mining operation because its fibers are capable of trapping gold nuggets, flakes and smaller particles that would otherwise end up back in the ground. When miner's moss 30 is full of material, it is cleaned to separate dirt from gold particles.

Higher pressure water feed 16 is mechanically coupled to camlock fitting 34 which can be further mechanically coupled to a higher pressure water input. Higher pressure water feed 16 is further mechanically coupled to make-up water supply 38 with water supply valve 36.

Gold concentrator plate 14 further comprises miner's moss 30 covered with expandable metal 32. Miner's moss 30 is further mechanically coupled to plate 42. In some embodiments, plate 42 is made from aluminum and is sold.

To distinguish, the miner's moss 30 on gold concentrator plate 14 can be called upper miner's moss 30. The miner's moss 30 on bucket 10 can be called lower miner's moss 30. Upper miner's moss 30 is held in place with expandable metal 32 as shown in FIG. 3. Gold concentrator plate 14 does not cover the entire surface area of bucket 10, but rather partially covers the surface area of bucket 10.

Figure 5:
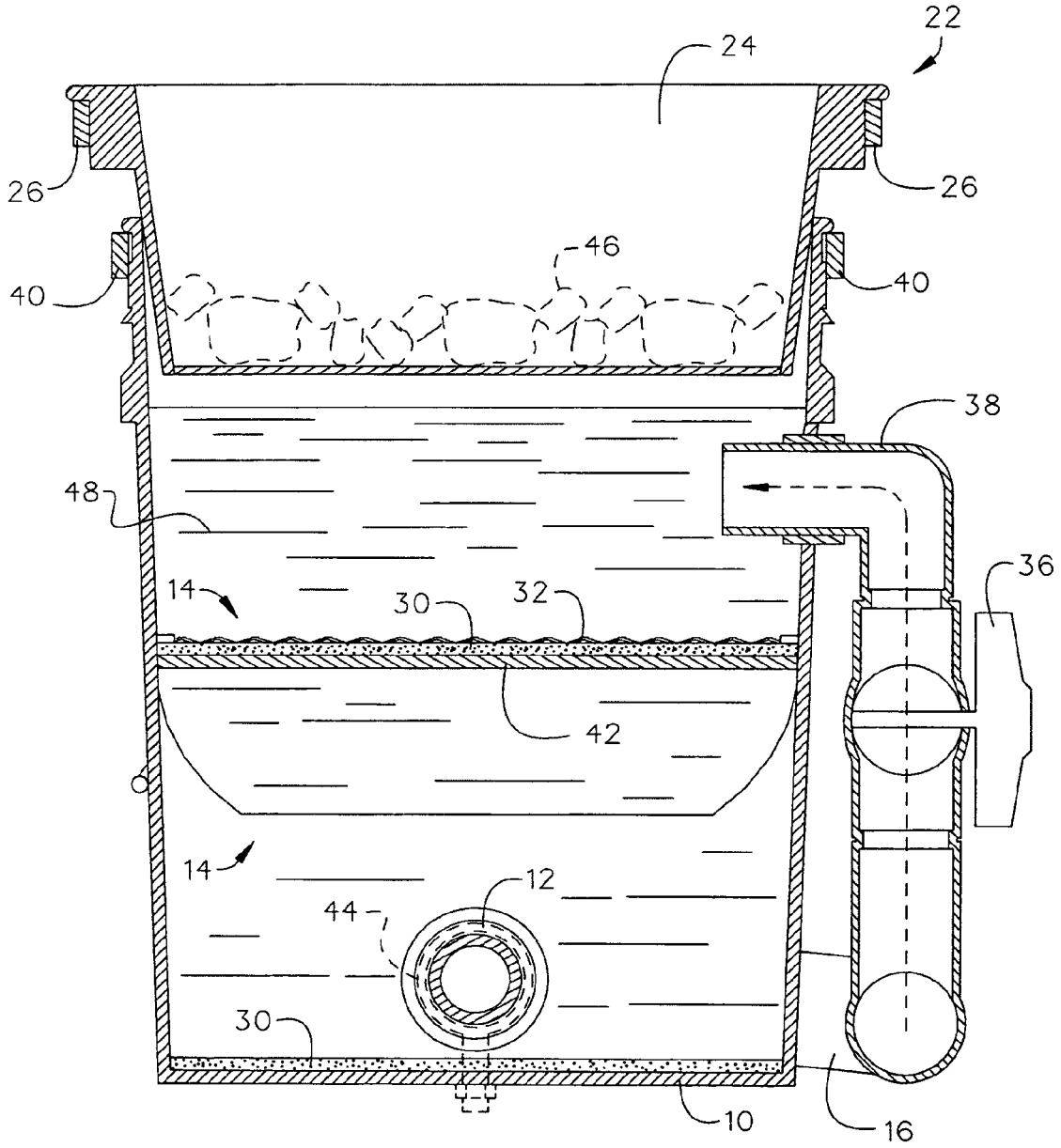
FIG. 5 is a section detail view of an embodiment of the invention along line 5-5 in FIG. 2 shown with the classifier assembly shown in closed configuration.
Figure 6:
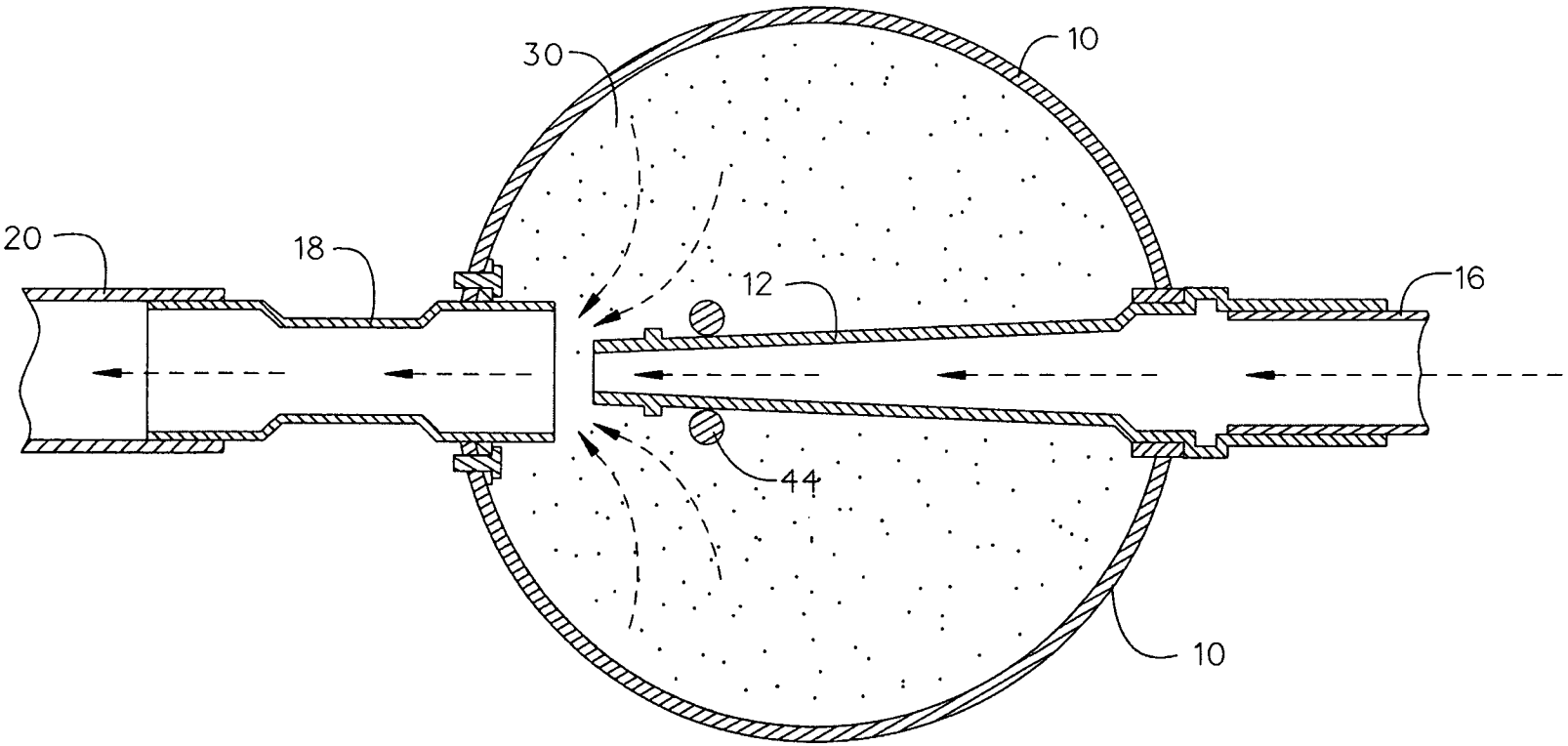
FIG. 6 is a section detail view of an embodiment of the invention along line 6-6 in FIG. 2.

FIG. 5 and FIG. 6 provide a theory of how to use the apparatus. Gravel and dirt is inserted into the top of classifier assembly 22. Larger material 46 rests upon classifier grate 28, while smaller material descends onto expandable metal 32. A user can then activate higher pressure water to enter bucket 10 through make-up water supply 12 causing water 48 to fill the bucket. After this, the user can close water supply valve 36 causing higher pressure water to travel through higher pressure water feed 16 out of nozzle 12 through bucket 10 and out of flow restrictor 18 to slurry output through lower pressure water line 20 which travels to sluice.

At this point a user can simply remove classifier assembly 22, perhaps with bucket ring and bracket 40. Then the user removes gold particles from upper miner's moss 30 and lower miner's moss 30. To expedite this process, gold connector plate 14 can be detachably coupled to bucket 10 to permit easy removal and replacement of gold connector plate 14.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. An apparatus configured to recover gold and transport gravel, the apparatus comprising:

a bucket mechanically coupled to a higher pressure water feed and a lower pressure water line;

a make-up water supply connected to the higher pressure water feed;

a classifier assembly attached to the bucket and configured to filter larger material from smaller material; wherein the smaller material includes gold particles and gravel a gold concentrator plate detachably coupled to the bucket and configured to segregate the gold particles from the gravel;

wherein water enters the higher pressure water feed and travels through the make-up water supply running across the gold concentrator plate and causing the gold particles to be caught in the gold concentrator plate;

wherein the water additionally travels through the lower pressure water line with the gravel transporting the gravel away from the bucket; wherein the classifier assembly further comprises a classifier carriage mechanically coupled to a classifier ring and a classifier grate; wherein the gold concentrator plate further comprises a upper miner's moss covered with an expandable metal; and the upper miner's moss is further mechanically coupled to a plate.

2. The apparatus of claim 1, wherein the bucket is attached to a lower miner's moss to further segregate gold particles.

3. The apparatus of claim 1, wherein the bucket is attached to a nozzle and the nozzle is attached to the higher pressure water feed to direct water through the lower pressure water line.

* * * * *